US005842721A

United States Patent [19]

Kawabe

[11] Patent Number: 5,842,721

[45] Date of Patent: Dec. 1, 1998

[54] PAPER SHEET HOLDER

[75] Inventor: Ryu Kawabe, Tama, Japan

[73] Assignee: Iwao Yokoyama, Ichikawa, Japan; a part interest

[21] Appl. No.: 819,974

[22] Filed: Mar. 18, 1997

[51] Int. Cl.[6] ..... B42D 3/00

[52] U.S. Cl. ..... 281/45; 281/45; 281/DIG. 1; 402/503

[58] Field of Search ..... 281/44, 45, DIG. 1, 281/15.1; 462/1, 4, 503

[56] References Cited

U.S. PATENT DOCUMENTS

| | | | |
|---|---|---|---|
| 3,168,954 | 2/1965 | Von Herrmann | 281/44 |
| 4,255,837 | 3/1981 | Holtz | 281/DIG. 1 |

FOREIGN PATENT DOCUMENTS

| | | | |
|---|---|---|---|
| 2270652 A | 12/1975 | France . | |
| 1 289 513 | 2/1969 | Germany | 281/DIG. 1 |
| 1841690 A | 1/1932 | U.S. . | |
| 588397 | 2/1945 | United Kingdom | 281/DIG. 1 |
| 8905022 A | 6/1989 | WIPO . | |

*Primary Examiner*—Willmon Fridie, Jr.
*Attorney, Agent, or Firm*—Wenderoth, Lind & Ponack, L.L.P.

[57] ABSTRACT

A paper sheet holder is provided and includes a base plate (1), a paper sheet guiding plate (3) made of non-magnetic material, which is arcuate as viewed in a top plan (upper direction), a permanent magnet (4) fixed at a convex side surface of the paper sheet guiding plate, and a movable permanent magnet (5) movably and magnetically attracted by the curved outer wall surface at the concave surface of the paper sheet guiding plate. The guiding plate is fixed in a slanted orientation above the base plate. A paper sheet holder includes a base plate (25), a paper sheet guiding plate (26) made of non-magnetic material, a plurality of permanent magnets (27) embedded in the paper sheet guiding plate while being spaced apart by a predetermined distance in a horizontal direction, and a plurality of movable permanent magnets (30) spaced apart by a predetermined distance in a horizontal direction. The movable permanent magnets are magnetically attracted to both side surfaces or one side surface of the paper sheet guiding plate.

18 Claims, 10 Drawing Sheets

PAPER SHEET HOLDER

BACKGROUND OF THE INVENTION

1. Field of the Invention

This invention relates to a paper sheet holder having as its object holding of paper sheets in a generally vertical orientation, and more particularly a paper sheet holder having as its object holding of the paper sheets by employing a magnetic attracting force of a permanent magnet.

2. Description of the Related Art

In the present technology for vertically supporting a paper sheet, it is well known in the art to provide a device using a permanent magnet. This device is widely known as a combination of a ferromagnetic plate and a permanent magnet block, and is used in various forms. For example, there is a case in which a paper sheet is fixed to a bulletin board formed of an iron plate with a permanent magnet block.

In addition, it is also known to hold an upper end of a manuscript, a reference document or the like by means of a spring-type binder which can be placed on a desk.

In turn, it is also known to hold a paper sheet having a specified strength and printed with a menu or the like by means of a base material having a groove therein such as a menu stand which is placed on a table in a restaurant or the like so as to vertically hold the sheet.

In the aforesaid conventional art utilizing a permanent magnet, the paper sheet is fixed by a permanent magnet block having a surface in parallel with a surface of the ferromagnetic plate. A specified amount of contact area of the block is against a ferromagnetic plate, which has a larger area than that of the paper sheet to be held. In the case where the paper sheet is to be held, the permanent magnet block is removed by one hand from the ferromagnetic plate while the paper sheet is being held by the other hand, and subsequently the paper sheet is fixed against the ferromagnetic plate with the permanent magnet block while the paper sheet is being pushed against the ferromagnetic plate. In addition, in the case where the paper sheet is to be removed from the ferromagnetic plate, at first, the paper sheet is being held by one hand while the permanent magnet block is removed from the ferromagnetic plate by the other hand, and then the paper sheet is removed from the ferromagnetic plate. That is, the vertical holding and removal of the paper sheet cannot be carried out by only one hand. Additionally, in the case where a plurality of paper sheets are held, pulling-out of only one required sheet of paper from the plurality of sheets, and in turn insertion of only one sheet of paper to be added cannot be carried out while the permanent magnet block is being magnetically attracted to the ferromagnetic plate. Also, in this case, a one-handed operation for the paper sheet removal or insertion cannot be performed.

In addition, the known arrangements which employ the aforesaid permanent magnet is operated such that the paper sheet is fixed by the permanent magnet to the ferromagnetic plate which has a larger size than that of the paper sheet to be held and so it has a problem in that the holder becomes a hindrance when the block is mounted on a desk.

Further, also in the case where a spring-type binder is utilized, it is difficult to pull out a manuscript or a reference document or the like with one hand and pulling-out or insertion of the document cannot be carried out easily and within a short period of time when a word processor and a type writer or the like are operated.

In turn, as found in the menu stand which is placed on a table in a restaurant or the like, in the arrangement in which the paper sheet is fitted on a base member having a groove and is vertically held therein, a paper sheet has a specified strength, so that this technology has a problem in which a cost reduction is not achieved.

SUMMARY OF THE INVENTION

This invention has solved the aforesaid prior art problems by arranging a permanent magnet at one side surface of a paper sheet guiding plate which is made of non-magnetic material and is fixed on a base member. Alternatively, the permanent magnet can be embedded within the paper sheet guiding plate so as to magnetically attract a movable permanent magnet having a curved outer wall surface in contact with the other side surface of the paper sheet guiding plate. The paper sheet is inserted or pulled from between the other side surface of the paper sheet guiding plate and the curved surface of the movable permanent magnet while the curved surface of the movable permanent magnet continues to be magnetically attracted to the other side surface of the paper sheet guiding plate.

In this case, there is no difference in actions and effects of the present invention even if any one of the fixed or embedded permanent magnet or the movable permanent magnet is composed of a ferromagnetic member.

In this case, the use of the word "movable" in regard to the movable permanent magnet and the movable ferromagnetic member described in the specification of the present invention, means that either of the permanent magnet or the ferromagnetic member can be magnetically attracted to the side surface of the paper sheet guiding plate or removed from it, and further either the permanent magnet or the ferromagnetic member can freely slide in a vertical or a lateral direction along the side surface of the paper sheet guiding plate as well as it can freely rotate on the side surface of the paper sheet guiding plate while the permanent magnet or ferromagnetic member is attracted to the side surface of the paper sheet guiding plate.

Also, in this specification, vertical holding of the paper sheet means not only to hold the paper sheet vertically but also to hold the paper sheet in a somewhat inclined orientation relative to a vertical line, such as an inclination of 5° to 30° relative to a vertical line.

That is, the first paper sheet holder proposed by the present invention is comprised of a paper sheet guiding plate made of non-magnetic material and fixed above a base plate, a permanent magnet fixed to one side surface of the paper sheet guiding plate or embedded in the paper sheet guiding plate, and a movable permanent magnet or a movable ferromagnetic member movably and magnetically attracted to the other side surface of the paper sheet guiding plate.

Further, a second paper sheet holder proposed by the present invention is comprised of a paper sheet guiding plate made of non-magnetic material and fixed above a base plate, a permanent magnet fixed to one side surface of the paper sheet guiding plate or embedded in the paper sheet guiding plate, a movable permanent magnet or a movable ferromagnetic member movably and magnetically attracted to the other side surface of the paper sheet guiding plate, and a means arranged at the other side surface of the paper sheet guiding plate for preventing either the movable permanent magnet or the movable ferromagnetic member from disengaging or dropping.

In the first paper sheet holder of the present invention, it is possible to cause the base plate to have a function of preventing the paper sheets and the movable permanent magnet from dropping or disengaging in a vertical direction.

That is, it is necessary to prevent the paper sheets and the movable permanent magnet from dropping or disengaging in a vertical direction in the case where a sufficient magnetic attraction force cannot be realized due to the large number of paper sheets to being vertically and the increased thickness or in the case that the heavy paper sheets cannot be supported only with the magnetic force or the like. In this case, the dropping and disengaging of the paper sheets in a vertical direction can be prevented by providing a predetermined width to the base plate.

In turn, if the structure for use in fixing the paper sheet guiding plate above the base plate in a slanted direction is employed, it is possible to prevent the paper sheets and the movable permanent magnet from being dropped and disengaged by the inclination of the paper sheet guiding plate and the magnetic attracting force between the movable permanent magnet or the movable ferromagnetic member and the permanent magnet fixed to the rear side of the paper sheet guiding plate, so that the structure as described above is employed and it is not necessary to rely on the base plate to prevent the paper sheet and the movable permanent magnet from being dropped and disengaged in a vertical direction.

In addition, in the second paper sheet holder of the present invention, since the side surface of the paper sheet guiding plate to which the movable permanent magnet or the movable ferromagnetic member is magnetically attracted is provided with a means for preventing the movable permanent magnet and the movable ferromagnetic member from being disengaged, it is not necessary to give a special consideration to the base member in order to prevent the paper sheets from dropping or disengaging or to make a slanted arrangement of the paper sheet guiding plate on the base member.

In the first and the second paper sheet holders of the present invention, if the paper sheet guiding plate is formed into an arcuate shape into which either the movable permanent magnet or the movable ferromagnetic member is attracted, the paper sheet can be held vertically even if the paper sheet guiding plate has a quite smaller area than an area of the paper sheet to be held. If the arcuate paper sheet guiding plate is curved at a rear side of the paper sheet guiding plate as viewed from its top plan (upper direction), the paper sheet can be curved along with the curved surface of the guiding plate and held vertically.

A similar action and a similar effect can be attained by making the side surface, where either the movable permanent magnet or the movable ferromagnetic member is magnetically attracted, into a corrugated surface. However, in this case, an increased clearance between the permanent magnet, fixed on the rear side of guiding plate, and either the movable permanent magnet or the movable ferromagnetic member causes the magnetic attracting force to be decreased, so that this state requires a certain attention.

Even in the case that the paper sheet guiding plate is not formed into an arcuate shape as described above, i.e. in the case where a flat paper sheet guiding plate is used, arrangement of supporting members supporting the paper sheet while being curved at lateral right and left sides of the paper sheet guiding plate enables the paper sheet to be held vertically in the same manner by the paper sheet guiding plate which has a significantly smaller area than an area of the paper sheet.

That is, in an arrangement in which the paper sheet guiding plate is formed into an arcuate shape having a concave surface, viewed from its top plan, to which the movable permanent magnet or the like is magnetically attracted, the paper sheet guiding plate is fixed in a slanted orientation above the base plate and the disengaging preventive means of horizontal projecting state for the paper sheets and the movable permanent magnet or the like is arranged at a lower end of the paper sheet guiding plate. The paper sheets have a far larger area than an area of the paper sheet guiding plate and can be held vertically along an inclination angle of the paper sheet guiding plate and curved along the concave surface of guiding plate while the paper sheets are prevented from dropping and disengaging.

In the first and the second paper sheet holders of the present invention, it is preferable that either the movable permanent magnet or the movable ferromagnetic member is formed into a shape having a curved outer wall surface such as a disk-shape, a spherical shape, an ellipse spherical shape, a semi-disk shape, a semi-sphere shape, a semi-ellipse sphere shape, or either a column like shape or a cylindrical shape having a circular section or an ellipse section. By forming the outer wall surface into such shapes, as before described, an area of either the movable permanent magnet or the movable ferromagnetic member in contact with the side surface of the paper sheet guiding plate becomes quite small. As a result, the resistance between the movable permanent magnet, the movable ferromagnetic member and the side surface of the paper sheet guiding plate is also reduced, so that the movable permanent magnet and the movable ferromagnetic member can freely slide on the side surface of the paper sheet guiding plate in a vertical or a lateral direction as well as freely rotate on the side surface irrespective of the fact that they are forcedly attracted to the side surface of the paper sheet guiding plate with a magnetic force between it and the permanent magnet at the rear side of the paper sheet guiding plate.

With such an arrangement as above, it becomes possible to easily insert or remove the paper sheet between the paper sheet guiding plate and the movable permanent magnet or the like, while either the movable permanent magnet or the movable ferromagnetic member continues to be magnetically attracted to the paper sheet guiding plate, and thus it is possible to hold or remove the paper sheet with only one hand.

In addition to the arrangement in which either the movable permanent magnet or the movable ferromagnetic member itself is formed into such a shape as one contacting with the paper sheet guiding plate via a curved outer wall surface, it is possible to construct either the movable permanent magnet or the movable ferromagnetic member as follows. That is, it is possible to provide an arrangement in which either the movable permanent magnet or the movable ferromagnetic member is formed into any one of a spherical, semi-spherical, ellipse spherical or semi-ellipse spherical shape made of non-magnetic material having either the permanent magnet or the ferromagnetic member piece within it. Alternatively, an arrangement in which either the permanent magnet piece or the ferromagnetic member piece is movably disposed in any one of a hollow sphere, hollow semi-sphere, hollow ellipse sphere or hollow semi-ellipse sphere formed of non-magnetic material. With all of these arrangements, either the movable permanent magnet or the movable ferromagnetic member contacts the side surface of the paper sheet guiding plate and has a curved shape. Further, it is possible to utilize a magnetic attracting force between the movable member of and the permanent magnet fixed to rear side surface of the paper sheet guiding plate or embedded in the paper sheet guiding plate. As described above, it is also possible to easily insert the paper sheet between them or remove the sheet from between them while either the movable permanent magnet or the movable ferromagnetic member continues to be magnetically attracted to the paper sheet guiding plate.

With the foregoing arrangement, in the case where the permanent magnet is fixed on the rear side of paper sheet guiding plate and the permanent magnet piece is placed in the sphere, a semi-sphere, an ellipse sphere or semi-ellipse sphere formed of solid non-magnetic material, if the permanent magnet piece is eccentrically placed in it, it becomes possible to make an adjustment in which the curved outer wall surface always contacts the side surface of the paper sheet guiding plate, and thereby adjust a magnetic attracting force between the permanent magnet fixed on the rear side of paper sheet guiding plate and the permanent magnet piece.

In addition, it becomes also possible to construct either the movable permanent magnet or the movable ferromagnetic member by making a part of the outer wall surface in the solid sphere of non-magnetic material with either the permanent magnet piece or the ferromagnetic member piece.

In turn, in the case where the permanent magnet piece is eccentrically placed in the solid spherical member or the like and the one which is fixed to rear side surface of the paper sheet guiding plate or which is embedded in the paper sheet guiding plate is also a permanent magnet in such a configuration as above, it is necessary to consider the fixing, embedding of the permanent magnet at the side of the paper sheet guiding plate or arrangement of the permanent magnet piece in the movable permanent magnet in reference to their relative polarities, i.e. their attracting directions, resulting in the inconvenience of troublesome assembling work for the product.

In the case where the permanent magnet piece is disposed within the hollow sphere or the like in such a manner that the magnet piece is freely movably, the construction of the movable permanent magnet will not present the inconvenience involved in the above assembly. That is, when the permanent magnet piece is attracted to the permanent magnet at the rear side of the paper sheet guiding plate, the permanent magnet is capable of being freely moved within the hollow sphere, and thus its attitude may be arranged in such a direction in which the fixed permanent magnet can attract it.

In the foregoing arrangement, although it has been employed to provide a configuration in which the permanent magnet is fixed to one (rear) side surface of the paper sheet guiding plate and either the movable permanent magnet or the movable ferromagnetic member is magnetically and movably attracted at the other (front) side surface of the paper sheet guiding plate, and in opposition to the above, it is also possible to fix the ferromagnetic member to one (rear) side surface of the paper sheet guiding plate or embed the ferromagnetic member in the paper sheet guiding plate and employ a configuration in which the movable permanent magnet is movably and magnetically attracted to the other (front) side surface of the paper sheet guiding plate.

A third paper sheet holder proposed by the present invention includes a paper sheet guiding plate made of non-magnetic material, arranged in an inclined manner above a base plate. A plurality of permanent magnets are spaced apart by a predetermined distance in a horizontal direction and are embedded in the paper sheet guiding plate. Also, a plurality of movable permanent magnets or movable ferromagnetic members are spaced apart by a predetermined distance in a horizontal direction and are movably and magnetically attracted to both side surfaces or one side surface of the paper sheet guiding plate.

In this case, either the movable permanent magnet or the movable ferromagnetic member has a shape which will contact with the paper sheet guiding plate with a curved outer wall surface, such as a column-like member or a cylindrical member having a circular section or an elliptical section. A reason why the shape of the part of either the movable permanent magnet or the movable ferromagnetic member, contacting the paper sheet guiding plate, is set as a curved surface is similar to those of the foregoing first and second paper sheet holders of the present invention.

Accordingly, in addition to the configuration in which the shapes of the movable permanent magnet and the movable ferromagnetic member are set, it is also possible to construct either the movable permanent magnet or the movable ferromagnetic member in column-like members of non-magnetic material having a circular section or an elliptical section. Within the column-like members, a plurality of permanent magnets or ferromagnetic member pieces are spaced apart by a predetermined distance. Alternatively, either the permanent magnet pieces or the ferromagnetic member pieces, for each section of the hollow cylinders of nonmagnetic material of circular section or elliptical section, may be partitioned into a plurality of segments in a longitudinal direction.

In this paper sheet holder, a plurality of permanent magnets are spaced apart by a predetermined distance in a horizontal direction in the paper sheet guiding plate, and a plurality of movable permanent magnets, which are magnetically attracted to the paper sheet guiding plate, are also spaced apart by a corresponding predetermined distance, so that the paper sheet can be held vertically by the movable permanent magnets or the like. Since magnetic forces between a plurality of permanent magnets in the paper sheet guiding plate and a plurality of movable permanent magnets or the like are utilized, this third paper sheet holder is effective for vertically holding paper sheets which are thicker and have a heavier weight than those of the first and the second paper sheet holders. In this paper sheet holder, the base plate may act to prevent the paper sheet and the movable permanent magnets or the like from being dropped or disengaged in a vertical direction.

In this case, similar to the first and the second paper sheet holders of the present invention, the members embedded in the paper sheet guiding plate, made of non-magnetic material, may be altered to a plurality of ferromagnetic members, so that a plurality of movable permanent magnets, which are spaced apart by a predetermined distance in a horizontal direction and movably and magnetically attracted to both side surfaces or one side surface of the paper sheet guiding plate, may also be applied.

According to the present invention, it is possible to hold the paper sheet accurately in a vertical direction irrespective of the number of paper sheets and the insertion and removal of the paper sheets can be performed simply and easily with only one hand.

In addition, since the movable permanent magnets and the fixed permanent magnets keep their relative positions due to the attraction of their magnetic forces, there is no possibility that a certain trouble may occur which differs from the case in which a fixing piece or the like is present.

DESCRIPTION OF THE PREFERRED EMBODIMENTS

(Embodiment 1)

Figure 1:
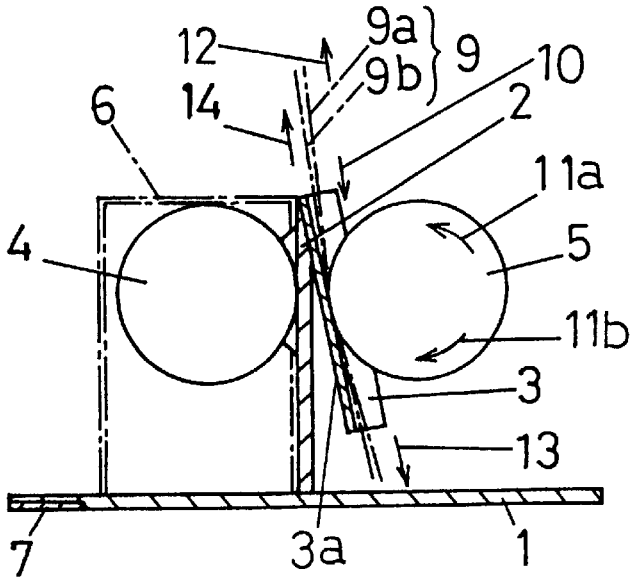
FIG. 1 is a side elevational view in longitudinal section showing a paper sheet holder of the preferred embodiment of the present invention.
Figure 2:
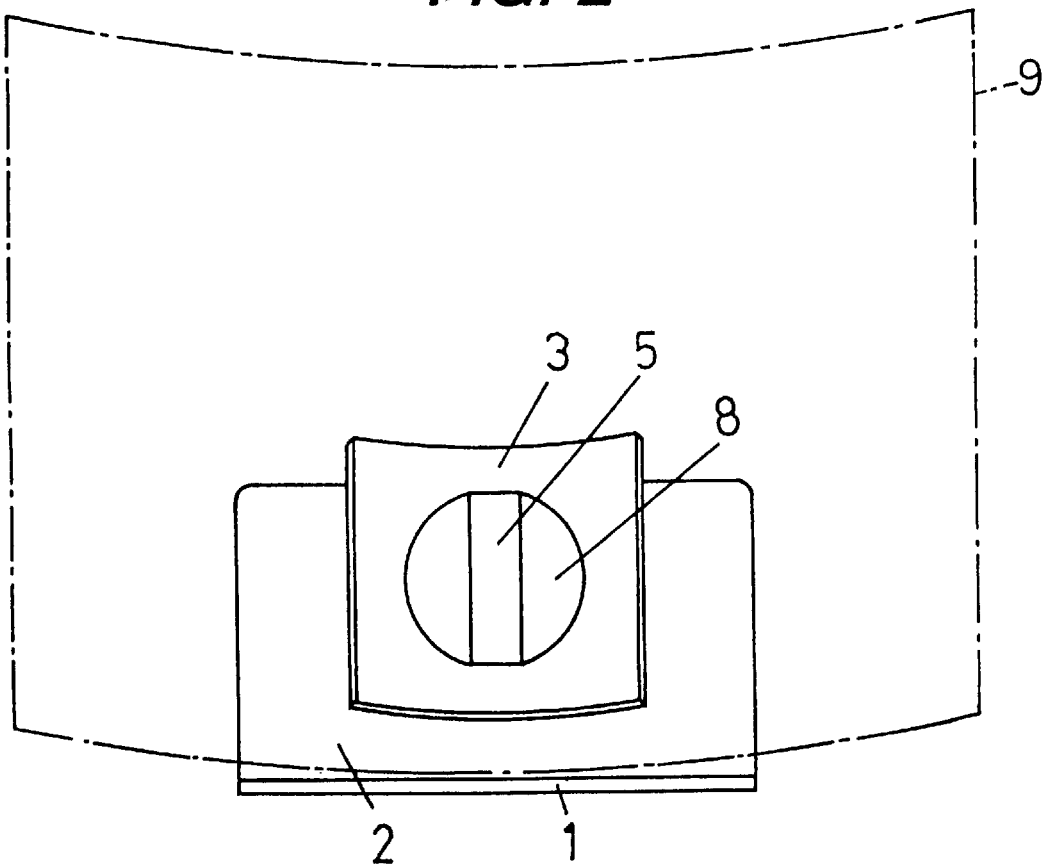
FIG. 2 is a front elevational view showing the paper sheet holder shown in FIG. 1.
Figure 3:
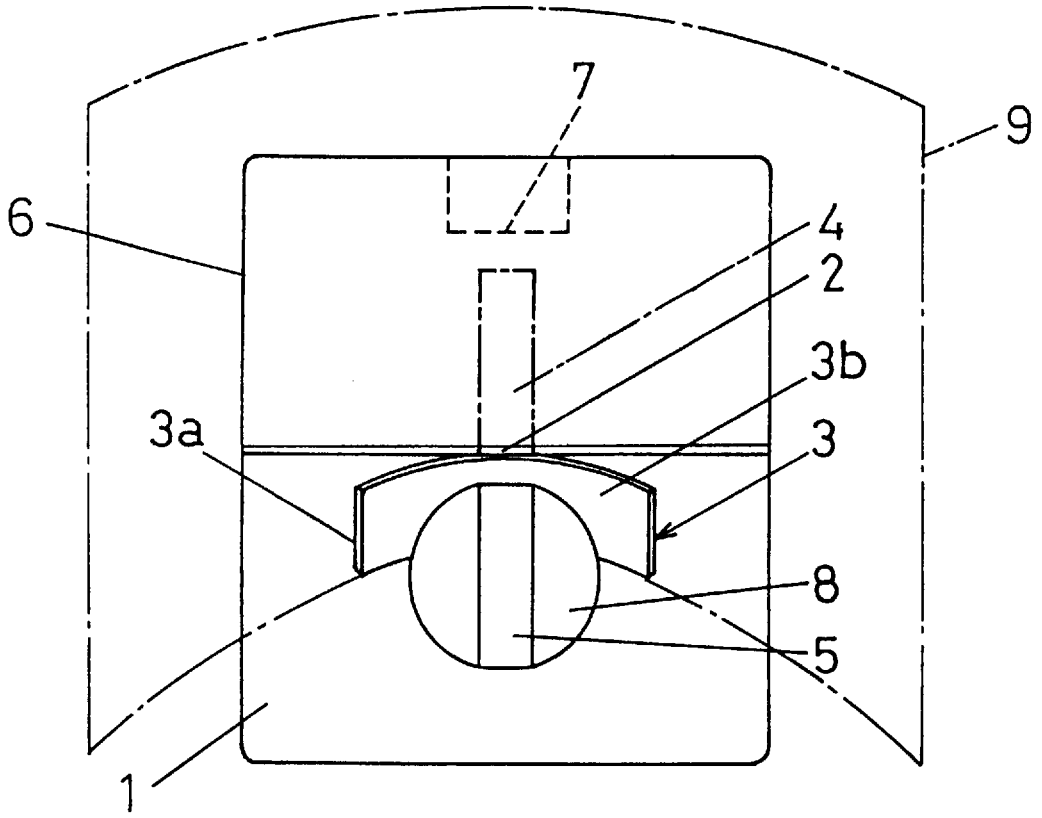
FIG. 3 is a top plan view of the paper sheet holder shown in FIG. 1.

Referring now to FIGS. 1, 2 and 3, one preferred embodiment of the present invention will be described as follows.

A supporting plate 2 is mounted vertically on a base plate 1 which is made of non-magnetic material such as synthetic resin. A paper sheet guiding plate 3 is made of non-magnetic material such as synthetic resin and is fixed to the supporting plate 2 in an inclined state. The paper sheet guiding plate 3 is formed in a concave arcuate shape as viewed in its top plan.

A disc-like permanent magnet 4 is fixed to the supporting plate 2 positioned at a side of a convex surface 3a of the paper sheet guiding plate 3. A paper sheet holding member 5, which may be a permanent magnet, is in contact with and magnetically attracted to a concave surface 3b of the paper sheet guiding plate 3. Reference numeral 6, in FIG. 1 and FIG. 3, denotes a cover for the permanent magnet 4. A permanent magnet piece 7 for fixing a paper sheet holder to a wall surface or the like is fixed to one side of the base plate 1.

Although the paper sheet holding member or movable permanent magnet 5 has a disc-like shape, it is embedded in a sphere 8 formed of a transparent synthetic resin, with the result that its entire outer shape forms a sphere, as shown in FIG. 2.

In the aforesaid preferred embodiment, when a paper sheet 9 is pushed into the paper sheet holder as indicated by an arrow 10, the sphere 8, including the disk-like shape permanent magnet 5, is rotated in a direction indicated by an arrow 11*a*, and the paper sheet 9 can be easily inserted into the paper sheet holder. When the paper sheet 9 is pulled in a direction indicated by an arrow 12, the sphere 8 including a disk-like shape permanent magnet 5 is rotated in a direction indicated by an arrow 11*b*, and is thereby easily removed from the paper sheet holder.

In the foregoing, as the weight of the sphere 8, including a disk-like shape permanent magnet 5, is increased more than a magnetic attracting force between the permanent magnets 4 and (for example, in the case that the number of paper sheets is increased), the sphere 8 drops together with the paper sheets 9, as indicated by an arrow 13. Accordingly, the paper sheets 9 cannot be pushed and held by the sphere 8 including the disk-like shape permanent magnet 5. In view of this fact, the paper sheet guiding plate 3 is slanted (for example, slanted by 10°) so as to reduce a dropping partial force of the sphere so as to enable the sphere 8 to be automatically returned back along the paper sheet guiding plate 3.

In this embodiment, even if a plurality of paper sheets 9 are pushed beyond the sphere 8 and held in the paper sheet holder, the paper sheet 9*a* at the forward most location has a relatively low frictional force (due to rotation of the sphere 8 including a disk-like shape permanent magnet 5), so that even if the paper sheet 9*a* is pulled up as indicated by an arrow 14, a paper sheet 9*b* placed at a next location maintains its present position. That is, even in the case in which only one paper sheet is pulled out of a plurality of paper sheets held in a vertical orientation or even in the case in which a new paper sheet is inserted into a plurality of held sheets, it is not necessary to intentionally remove the sphere 8 which includes the disk-like shape permanent magnet 5 from the paper sheet guiding plate 3.

In this embodiment, a disc-like movable permanent magnet is used as the movable permanent magnet 5 as illustrated in FIGS. 1, 2 and 3. In this case, as shown in FIGS. 1 and 3, a disc-like permanent magnet is used as a permanent magnet 4 and is fixed vertically to a rear surface side of the paper sheet guiding plate 3. If the disc-like permanent magnet 4 is not fixed vertically to a rear surface of the supporting plate 2 as shown in FIG. 1, a magnetic attracting force acting between the permanent magnet 4 and the disk-like permanent magnet 5 is not effectively applied, so that a certain amount of attention is required for the arrangement. This condition is required for a case in which the permanent magnet is fixed to the paper sheet guiding plate, the permanent magnet is also applied at a side pressing the paper sheet, and both permanent magnets are of a disc-like shape.

For example, in the case where the member, to be fixed to the rear side of the paper sheet guiding plate, is a ferromagnetic member such as an iron plate, even if the movable permanent magnet 5 is of a disc-like shape, it is satisfactory that a rectangular ferromagnetic member is applied to be fixed to a rear surface side of the paper sheet guiding plate 3.

Figure 4:
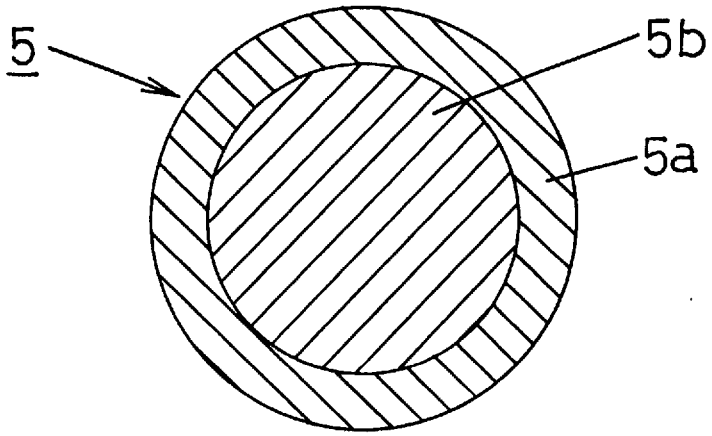
FIG. 4 is a sectional view showing the preferred embodiment of a movable permanent magnet used in the present invention.
Figure 5:
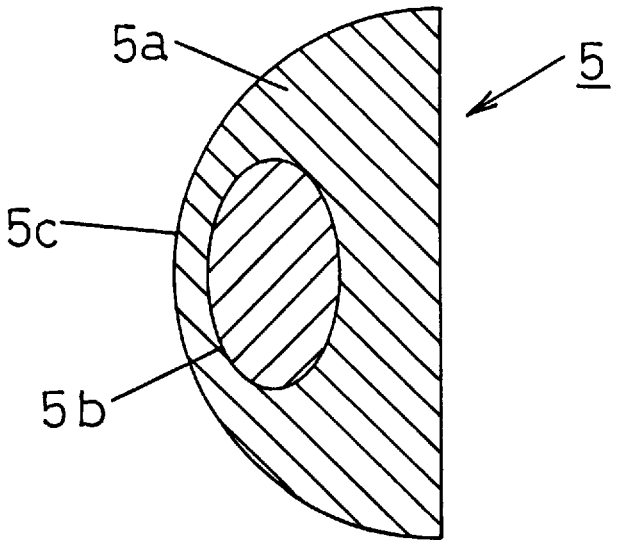
FIG. 5 is a sectional view showing another preferred embodiment of the movable permanent magnet used in the present invention.
Figure 6:
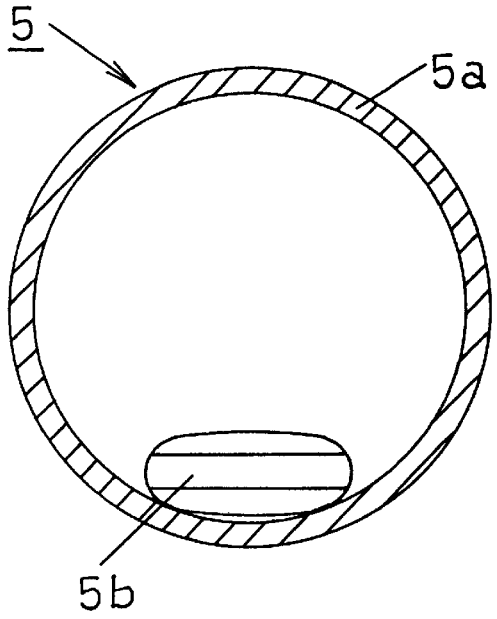
FIG. 6 is a sectional view showing a still further preferred embodiment of the movable permanent magnet used in the present invention.

In the case that the permanent magnet of spherical or semi-spherical shape as shown in FIGS. 4, 5, or 6 is used as the movable permanent magnet 5, it is satisfactory that a rectangular permanent magnet or a rectangular ferromagnetic member is applied to be fixed to a rear surface side of the paper sheet guiding plate 3.

The movable permanent magnet 5, shown in FIG. 4, is one in which a permanent magnet 5*b* is embedded in a sphere 5*a* of non-magnetic material. The movable permanent magnet 5 shown in FIG. 5 is one in which a permanent magnet 5*b* is embedded in a semi-sphere 5*a* made of non-magnetic material. If the permanent magnet 5*b* is eccentrically positioned as shown in FIG. 5, it is always possible to contact the curved spherical surface 5*c* with the paper sheet guiding plate 3. The movable permanent magnet 5 shown in FIG. 6 is one in which a permanent magnet piece 5*b* is movably disposed in the hollow sphere 5a made of non-magnetic material.

Figure 7:
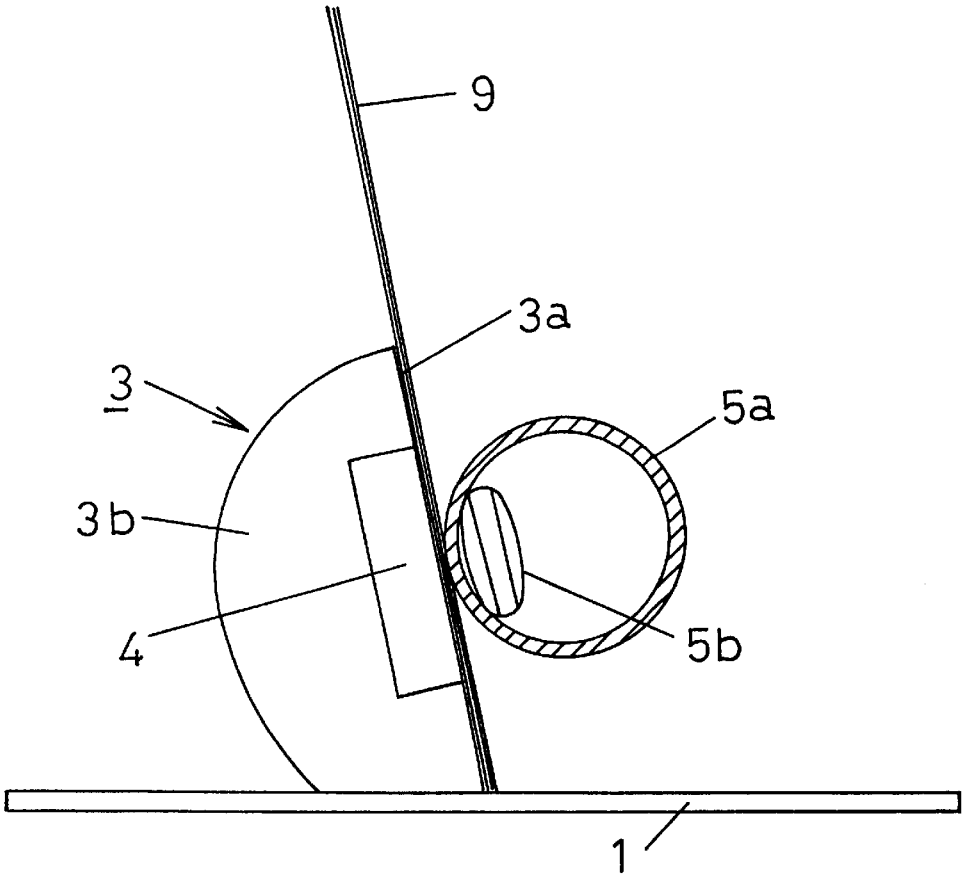
FIG. 7 is a side elevational view in longitudinal section showing the paper sheet holder of the present invention using the movable permanent magnet shown in FIG. 6.

FIG. 7 illustrates a case in which the paper sheet 9 is held with the movable permanent magnet 5 shown in FIG. 6. The permanent magnet piece 5b is freely moved in the hollow sphere 5*a*, applies an attracting force in compliance with a polarity of the permanent magnet 4 at the side of the paper sheet guiding plate 3 so as to hold the paper sheet 9. In the example shown in FIG. 7, the paper sheet guiding plate 3 is comprised of a flat surface 3*a* and a rear part 3*b* constituting its rear side. The permanent magnet 4 is embedded in the rear part 3*b*. It is also possible to make the rear part 3*b* into a shape of character goods or various other ornamental shapes so as to enjoy their visual appearances. It is also possible to fill a bell in the hollow movable permanent magnet 5 shown in FIG. 6 together with the permanent magnet piece 5*b*, to generate enjoyable sounds.

A shape and a configuration of the movable permanent magnet 5 are not limited to those shown in FIGS. 1 to 3, 4, 5 and 6, and if its shape is one in which it is contacted with the paper sheet guiding plate by and through its curved outer wall surface, various configurations may be employed for example, the permanent magnet itself my be made into a disc-like shape, a sphere, an ellipse sphere, a semi-disc shape, a semi-sphere, a semi-ellipse sphere or a column-like member, a cylindrical member having a circular section or an ellipse section as well as the permanent magnet piece being embedded in the sphere or the like or the permanent magnet is movably positioned in the hollow sphere or the like.

The paper sheet guiding plate 3 may be formed into a flat configuration as shown in FIG. 7, and may be formed into an arcuate shape as shown in FIGS. 1 to 3 in which its concave side surface is magnetically attracted to the movable permanent magnet 5. It is more preferable to apply the arcuate-shaped paper sheet guiding plate 3 as shown in FIGS. 1 to 3 in order to vertically hold a paper sheet 9 having a larger area than that of the paper sheet guiding plate 3.

In the foregoing description, the permanent magnet 4 is fixed to the paper sheet guiding plate 3 and a permanent magnet is also used as the movable permanent magnet 5. However, it is also possible to construct either one of them with a ferromagnetic member such as iron. However, it is preferable that both of them be permanent magnets in order to vertically hold paper sheets with a specified thickness and weight in view of a magnetic force.

(Embodiment 2)

Figure 8:
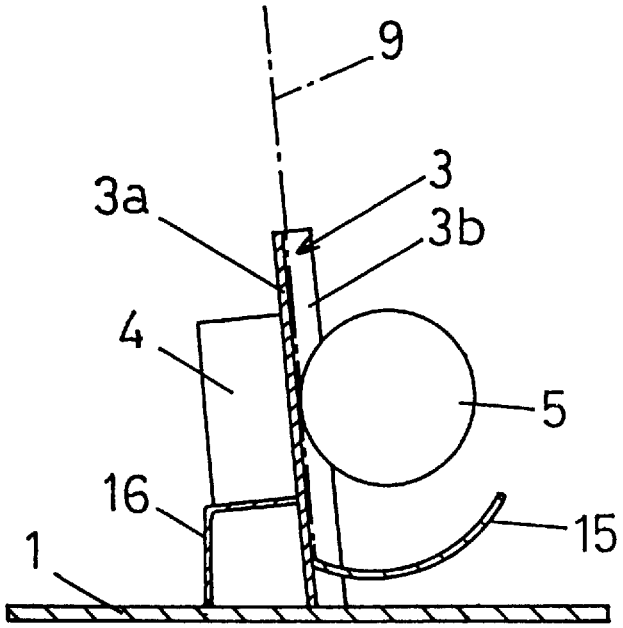
FIG. 8 is a side elevational view in longitudinal section of the paper sheet holder of another preferred embodiment of the present invention.
Figure 9:
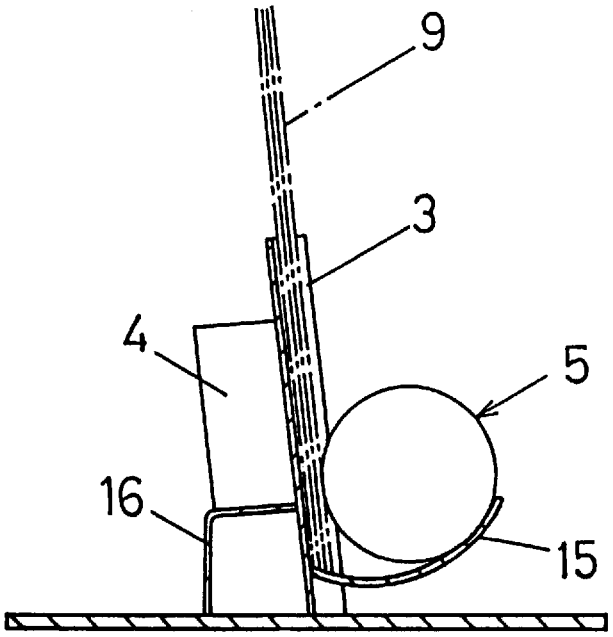
FIG. 9 is a side elevational view in longitudinal section showing a state in which many paper sheets are held in the paper sheet holder shown in FIG. 8.

Referring to FIGS. 8 and 9, a preferred second embodiment of the present invention will be described as follows.

A paper sheet guiding plate 3 made of non-magnetic material (for example, synthetic resin) having an arcuate shape as viewed from its top plan (an upper direction) is fixed to the base plate 1, which is made of non-magnetic material (for example, synthetic resin). A permanent magnet 4 is fixed to a convex surface 3*a* of the paper sheet guiding plate 3, and the movable permanent magnet 5 is slidably and rotatably contacted with the concave surface 3*b* and magnetically attracted to it. In this embodiment, a spherical permanent magnet is used as the movable permanent magnet 5.

The second embodiment is different from the first embodiment shown in FIGS. 1 to 3, in that a receiving plate 15 is arranged below the paper sheet guiding plate 3. In the case that the number of the paper sheets 9 to be held is increased or the weight of the paper sheets 9 to be held is heavy, there is a possibility that a magnetic force between the permanent magnet 4 and the movable permanent magnet 5 becomes insufficient to hold the paper sheets 9, so that the paper sheets 9 drop in a downward direction and along with the plate 3, and the movable permanent magnet 5 may also disengage and drop. However, the receiving plate 15 may act to prevent this state. The receiving plate 15 may receive the bottom end of paper sheets 9 and permanent magnet 5 as shown in FIG. 9. FIG. 9 illustrates the state in which the movable permanent magnet 5 is slid to the lower-most location and supported by receiving plate 15.

Since a relation between the paper sheet 9 and the movable permanent magnet 5 in this embodiment 2 is similar to that in the aforesaid embodiment 1, its detailed description has been eliminated.

(Embodiment 3)

Figure 10:
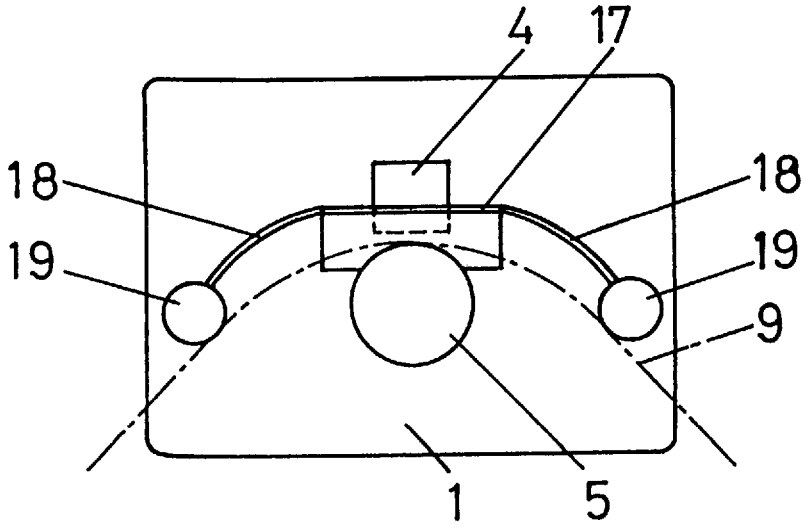
FIG. 10 is a top plan view showing the paper sheet holder of the present invention provided with the paper supporting member.
Figure 11:
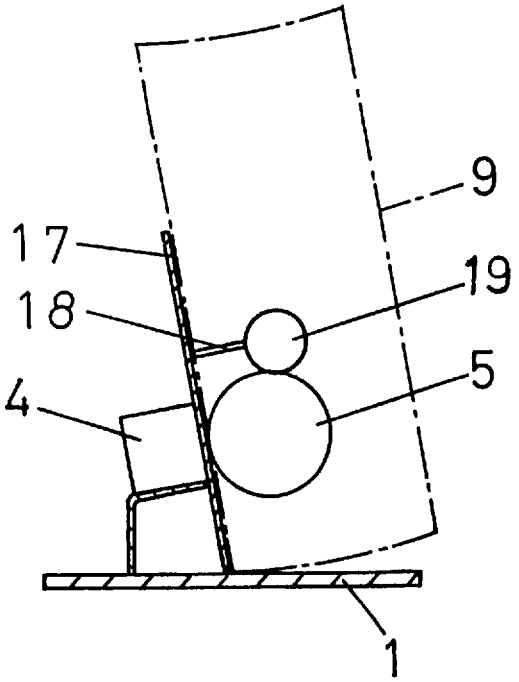
FIG. 11 is a side elevational view with a part of the paper sheet holder shown in FIG. 10 being cut away.

A third preferred embodiment, shown in FIGS. 10 and 11, is one in which a flat plate-like paper sheet guiding plate is used in place of the curved paper sheet guiding plate in the aforesaid first and second embodiments. That is, a paper sheet guiding plate 17, made of synthetic resin, is fixed in a slanted manner to the base plate 1 made of non-magnetic material. Arm levers 18 are projected in a lateral direction and in a forward direction (the movable permanent magnet side) from an intermediate edge of the paper sheet guiding plate 17. Also, guiding spheres 19 are fixed to the ends of the arm levers 18, respectively. The paper sheet 9 is curved and supported by the paper sheet guiding plate 17 and the guiding spheres 19.

With the above arrangement, even if the flat plate-like paper sheet guiding plate 17 is applied, it is possible to easily hold a paper sheet in a vertical position, even when the paper sheet has a larger area than that of the paper sheet guiding plate 17.

Since the method of using in the third embodiment is similar to that of the first embodiment, its description is eliminated.

(Embodiment 4)

Figure 12:
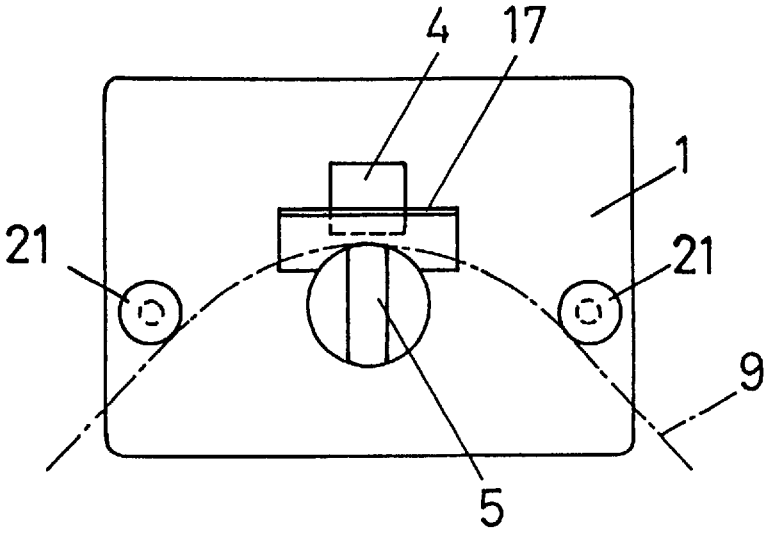
FIG. 12 is a top plan view for showing another paper sheet holder of the present invention provided with the paper sheet supporting member.
Figure 13:
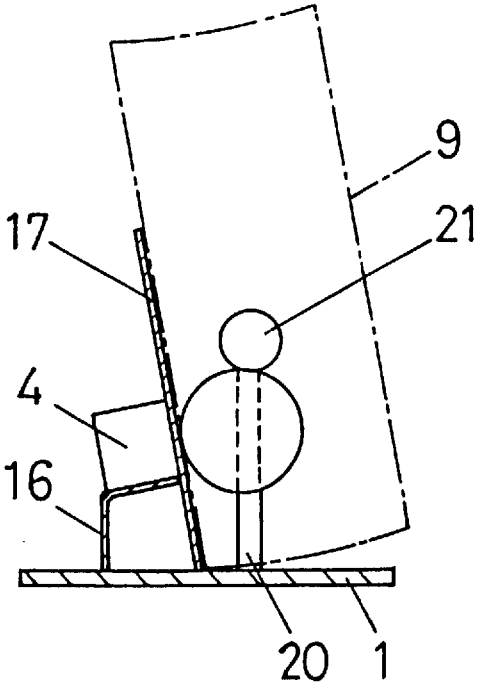
FIG. 13 is a side elevational view with a part of the paper sheet holder shown in FIG. 12 being cut away.

A fourth preferred embodiment shown in FIGS. 12 and 13, is constructed such that supporting levers 20 are vertically mounted on the base plate 1 in place of the arm levers 18 of the third embodiment. Guiding spheres 21 are fixed to the upper ends of the supporting levers 20 and the paper sheet 9 is curved and supported in the same manner as that of the third embodiment.

(Example of Application)

Figure 14:
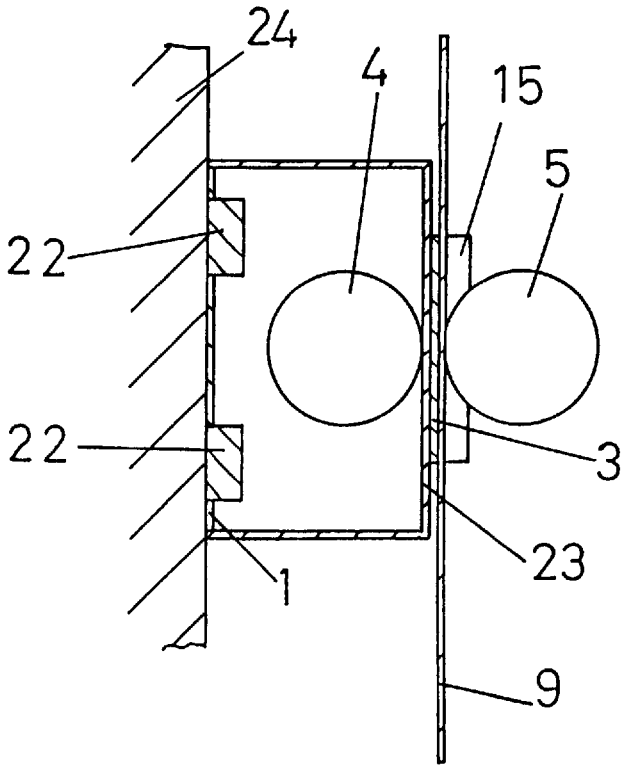
FIG. 14 is a cross sectional view showing an example in which the paper sheet holder of the present invention is fixed to a vertical wall.

FIG. 14 shows an example of an application (use) in which the paper sheet holder of the present invention is fixed to a vertical wall. Although the paper sheet holder of the present invention is normally mounted on a desk, it may also be magnetically attracted to a vertical wall and used there. In this case, since the base plate 1 is constructed in such a state in which it may be easily magnetically attracted to the wall, its example of application is shown.

That is, the permanent magnets 22 for use in magnetically fixing the paper sheet holder to a wall 24 are fixed to a rear surface of the base plate 1 which is made of synthetic resin. The permanent magnet 4 is fixed to a cover plate 23 which is fixed to the base plate 1, and then a paper sheet 9 is held between the movable permanent magnet 5 and the paper sheet guiding plate 3.

(Embodiment 5)

The fifth preferred embodiment shown in FIGS. 15 to 18, provides a paper sheet holder which is suitable for vertically holding a paper sheet having a specified weight and a specified thickness as found in a menu stand.

The paper sheet guiding plate 26 made of non-magnetic material (such as synthetic resin) is fixed on the base plate 25 which is made of non-magnetic material (such as synthetic resin). As shown in the figure, it is preferable that the paper sheet guiding plate 26 is slanted by a specified angle, such as about 5° to 30°, and is fixed on the base plate 25. This is applied in reference to the weight and thickness of the menu, etc. to be held.

Permanent magnets 27 are spaced apart by a predetermined distance in a horizontal direction and are embedded within the paper sheet guiding plate 26. Permanent magnets 30*a*, 30*b* are spaced apart by the same distance as the permanent magnets 27 in the paper sheet guiding plate 26 and are embedded in a column-like member 28. In turn, a hollow cylindrical member 29 is constructed such that permanent magnet pieces 33a, 33b are disposed in the cavities 32*a*, 32*b* which are partitioned by a partition 31. With such an arrangement as above, both the column-like member 28 and the hollow cylindrical member 29 are magnetically attracted at both sides of the paper sheet guiding plate 26 as indicated by arrows 34, 35.

Figure 15:
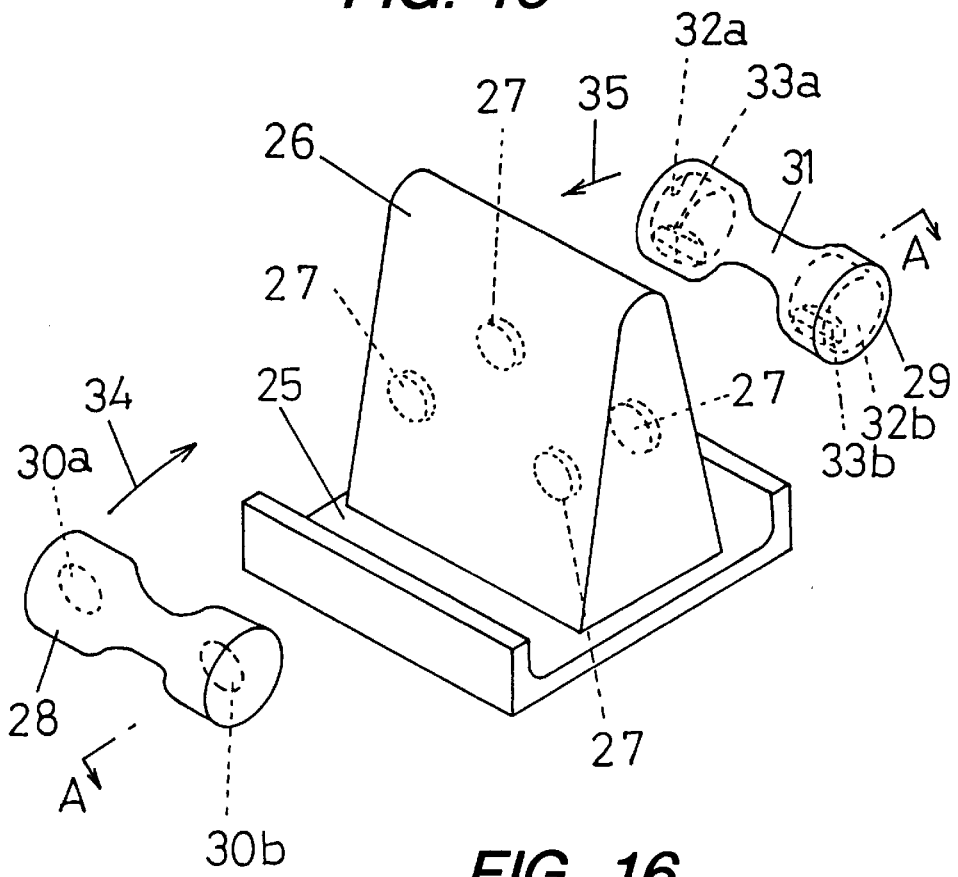
FIG. 15 is a perspective view showing another paper sheet holder of the present invention.

In the foregoing, a space for embedding the permanent magnets 27 is defined in response to the size and weight of the paper sheet to be vertically held. FIG. 15 illustrates a case in which two permanent magnets are embedded, however, three or four permanent magnets can be embedded in a desired space according to a size and weight of the paper sheet to be vertically held. It is necessary that a space between the permanent magnets embedded in the column-like member 28 or the like corresponds to a space between the permanent magnets 27 embedded in the paper sheet guiding plate 26.

Figure 16:
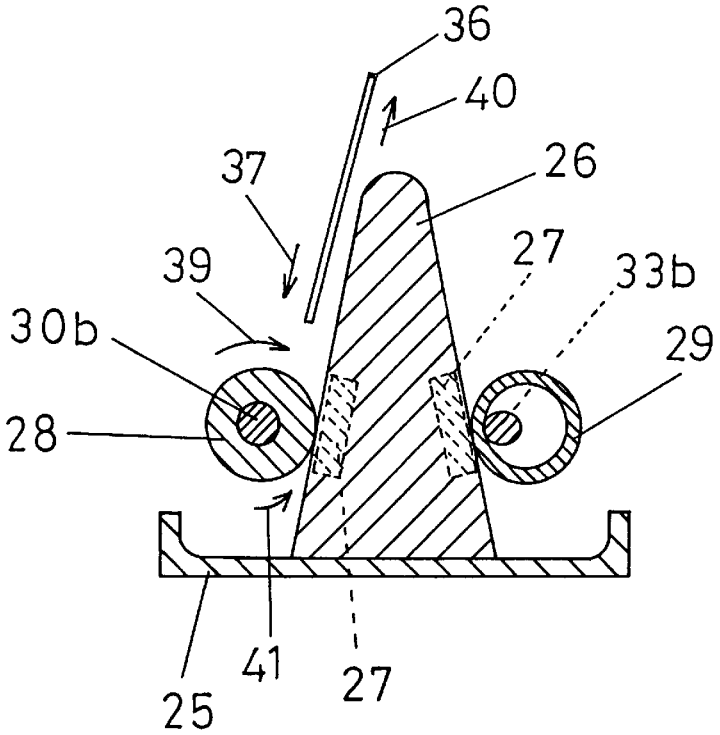
FIG. 16 is a sectional view taken along a line A-A of FIG. 15.

As shown in FIG. 16, when the paper sheet 36 having a specified weight and a specified thickness as found in a menu in a restaurant is inserted as indicated by an arrow 37 under a state in which the column-like member 28 and the cylindrical member 29 are magnetically contacted with to the paper sheet guiding plate 26, the column-like member 28 is rotated as indicated by an arrow 39 to hold the paper sheet 36 between it and the paper sheet guiding plate 26. As a result, the paper sheet 36 is vertically held by the magnetic forces between the permanent magnets 27 and 30*a*, 30*b*. In turn, as the paper sheet 36 is pulled out as indicated by an arrow 40, the column-like member 28 is rotated, as indicated by an arrow 41. Thus, it is possible to remove the paper sheet 36 without requiring any work such as removing the column-like member 28 from the paper sheet guiding plate 26 with the other hand.

In FIGS. 15 and 16, the column-like member 28 and the hollow cylindrical member 29 are both made of non-magnetic material such as synthetic resin and are illustrated as an example of each of the movable permanent magnet and the movable ferromagnetic member. However, it is also possible to insert the paper sheet 36 and to pull it out without removing the movable permanent magnet or the like from the paper sheet guiding plate 26 if the movable permanent magnet or the like can freely slide on the surface of the paper sheet guiding plate and rotate on it. That is, if the movable permanent magnet and the movable ferromagnetic member have such a shape in contact with the paper sheet guiding plate 26 at the curved outer wall surface, it is also possible to construct either the permanent magnet or the ferromagnetic member by itself into a column-like member or the like in addition to the column-like member 28 and the hollow cylindrical member 29 shown in FIG. 15 as a movable permanent magnet or the like. However, in a case where the permanent magnet is disposed in a hollow cylindrical member, it is necessary to arrange a partition at the middle part so as not to cause a plurality of permanent magnets to be attracted from each other.

In the examples shown in FIGS. 15 and 16, each of two permanent magnets is applied (a total of four) and one of them is embedded near each of the wall surfaces of the paper sheet guiding plate 26. However, it is also possible to apply two large-sized permanent magnets capable of approaching up to near both side surfaces of the paper sheet guiding plate 26 and to embed them in the plate 26 while being spaced apart by a predetermined distance.

Figure 17:
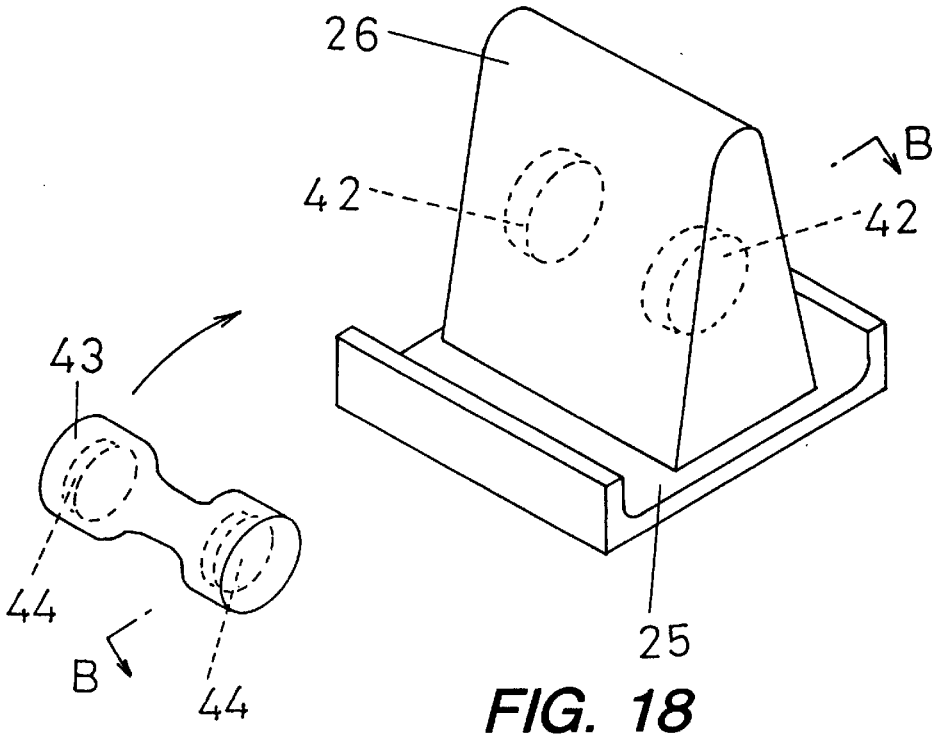
FIG. 17 is a perspective view for showing a still further paper sheet holder of the present invention.
Figure 18:
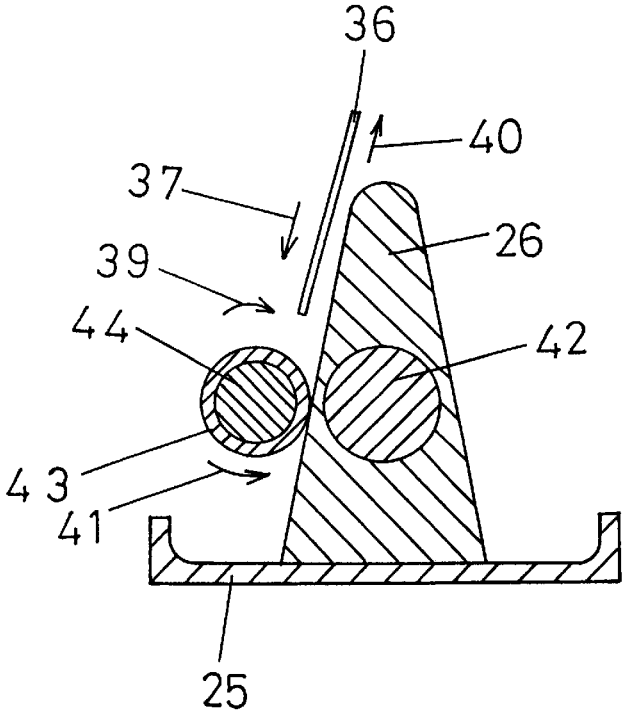
FIG. 18 is a sectional view taken along a line B-B of FIG. 17.

FIGS. 17 and 18 illustrate a preferred embodiment in which disc-like permanent magnets 42 are embedded in the paper sheet guiding plate 26 while being spaced apart in a horizontal direction. The disc-like permanent magnets 44 are embedded also in a column-like member 43 while being spaced apart by a predetermined distance in a horizontal direction. This method of application is the same as that shown in FIGS. 15 and 16, so that its description is eliminated.

Also in this embodiment, it is possible to apply not only a combination in which the member to be embedded in the paper sheet guiding plate 26 is a permanent magnet and a movable member magnetically attracted to the paper sheet guiding plate 26 is either a permanent magnet or a ferromagnetic member, but also a combination in which one embedded in the paper sheet guiding plate 26 is a ferromagnetic member and a movable member magnetically attracted to the paper sheet guiding plate 26 is a permanent magnet. However, it is preferable to employ permanent magnets for both in view of a relation of the magnetic forces.

Although the present invention has been described with reference to the particular preferred embodiments, it should be understood that various changes and modifications may be made within the spirit and scope of the invention as defined in the appended claims.

What is claimed is:

1. A paper sheet holder comprising:

a base plate;

a paper sheet guide structure fixed to said base plate, said paper sheet guide structure being formed of a non-magnetic material;

a permanent magnet fixed to a first side of said paper sheet guide structure or embedded in said paper sheet guide structure; and a paper sheet holding member including a permanent magnet piece or a ferromagnetic piece, said paper sheet holding member being movably disposed on a second side of said paper sheet guide structure, wherein said paper sheet holding member is held on said second side of said paper sheet guide structure due to a magnetic attraction between said permanent magnet and said paper sheet holding member.

2. The paper sheet holder as claimed in claim 1, wherein said paper sheet guide structure is arranged in a slanted orientation relative to said base plate.

3. The paper sheet holder as claimed in claim 1, wherein said paper sheet guide structure comprises a curved plate so that said first side of said paper sheet guide structure is a convex surface and said second side of said paper sheet guide structure is a concave surface.

4. The paper sheet holder as claimed in claim 1, wherein said paper sheet holding member has a curved outer peripheral surface for contacting said second side of said paper sheet guide structure.

5. The paper sheet holder as claimed in claim 1, wherein said paper sheet holding member comprises a construction having the form of one of a sphere, a semi-sphere, an ellipse sphere or a semi-ellipse sphere formed of non-magnetic material, and said permanent magnet piece or said ferromagnetic piece is disposed within said non-magnetic construction.

6. The paper sheet holder as claimed in claim 1, wherein said paper sheet holding member comprises a hollow non-magnetic structure having the form of one of a hollow sphere, a hollow semi-sphere, a hollow ellipse sphere or a hollow semi-ellipse sphere, wherein said permanent magnet piece or said ferromagnetic piece is movably disposed within said hollow non-magnetic structure.

7. The paper sheet holder as claimed in claim 1, wherein said paper sheet holding member is movable about a horizontal axis in response to insertion or removal of a paper sheet in said paper sheet holder.

8. A paper sheet holder comprising:

a base plate;

a paper sheet guide fixed to and extending above said base plate, said paper sheet guide being formed of non-magnetic material;

a permanent magnet fixed to a first side of said paper sheet guide or embedded within said paper sheet guide structure;

a paper sheet holding member disposed on a second side of said paper sheet guide and including a permanent magnet piece or a ferromagnetic piece, wherein said paper sheet holding member is held against said second side of said paper sheet guide due to the magnetic attraction between said permanent magnet and said paper sheet holding member; and a means for preventing said paper sheet holding member from disengaging from said second side of said paper sheet guide, said means being disposed at said second side of said paper sheet guide.

9. The paper sheet holder as claimed in claim 8, wherein said preventing means comprises a curved receiving plate connected to a lower portion of said second side of said paper sheet guide.

10. The paper sheet holder as claimed in claim 8, wherein said paper sheet guide is arranged in a slanted orientation relative to said base plate.

11. The paper sheet holder as claimed in claim 8, wherein said paper sheet guide comprises an arcuate plate, and said first side is a convex surface and said second side is a concave surface.

12. The paper sheet holder as claimed in claim 8, wherein said paper sheet holding member has a curved outer peripheral surface for contacting said second side of said paper sheet guide.

13. The paper sheet holder as claimed in claim 7, wherein:

said paper sheet holding member includes a non-magnetic construction having the form of one of a sphere, a semi-sphere, an ellipse sphere or a semi-ellipse sphere; and said permanent magnetic piece or said ferromagnetic piece is disposed within said non-magnetic construction.

14. The paper sheet holder as claimed in claim 8, wherein:

said paper sheet holding member comprises a hollow non-magnetic structure having the form of one of a hollow sphere, a hollow semi-sphere, a hollow ellipse sphere or a hollow semi-ellipse sphere; and said permanent magnetic piece or said ferromagnetic piece is movably disposed within said hollow non-magnetic structure.

15. A paper sheet holder comprising:

a base plate;

a paper sheet guide formed of a non-magnetic material and extending upwardly in a slanted manner from said base plate;

a plurality of permanent magnets embedded in said paper sheet guide, wherein said permanent magnets are spaced in a horizontal direction; and a paper sheet holding member magnetically attracted to said embedded permanent magnets such that said paper sheet holding members can be movably disposed on at least one side of said paper sheet guide, wherein said paper sheet holding member includes a plurality of horizontally spaced permanent magnet pieces or a plurality of horizontally spaced ferromagnetic pieces.

16. The paper sheet holder as claimed in claim 15, wherein said paper sheet holding member has a curved outer peripheral surface for contacting said paper sheet guide.

17. The paper sheet holder as claimed in claim 15, wherein:

said paper sheet holding member further comprises a column-like member formed of a non-magnetic material;

said column-like member having a circular or elliptical section; and said plurality of permanent magnet pieces or said ferromagnetic pieces are disposed within said column-like member and spaced by a predetermined distance.

18. The paper sheet holder as claimed in claim 17, wherein said plurality of permanent magnet pieces or said ferromagnetic pieces are movable relative to said column-like member, and said column-like member includes a plurality of segments spaced in a longitudinal direction in order to maintain said predetermined spacing of said permanent magnet pieces or said ferromagnetic pieces.

* * * * *